US006868573B2

(12) United States Patent
Röhl et al.

(10) Patent No.: US 6,868,573 B2
(45) Date of Patent: Mar. 22, 2005

(54) METHOD FOR OPERATING A PROGRAMMABLE WASHING MACHINE AND CORRESPONDING WASHING MACHINE

(75) Inventors: Marianne Röhl, Düsseldorf (DE); Detlef Uszkureit, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/765,585

(22) Filed: Jan. 26, 2004

(65) Prior Publication Data

US 2004/0226107 A1 Nov. 18, 2004

Related U.S. Application Data

(63) Continuation of application No. PCT/EP02/05625, filed on May 22, 2002.

(30) Foreign Application Priority Data

Jul. 26, 2001 (DE) ..... 101 36 519

(51) Int. Cl.[7] ..... D06F 33/00
(52) U.S. Cl. ..... 8/159; 68/12.12; 68/58
(58) Field of Search ..... 8/158–159; 68/12.12, 68/12.23, 24, 58

(56) References Cited

U.S. PATENT DOCUMENTS 3,344,447 A * 10/1967 Candor et al. ..... 8/159
5,392,480 A * 2/1995 Ishihara et al. ..... 8/159
5,560,061 A 10/1996 Wentzlaff et al.
6,386,004 B2 * 5/2002 Salein ..... 68/58
6,463,767 B2 * 10/2002 Uzkureit et al. ..... 68/58
2002/0000107 A1 1/2002 Salein
2002/0083743 A1 7/2002 Uszkureit et al.

FOREIGN PATENT DOCUMENTS

DE 43 10 595 A1 10/1994
DE 198 59 571 A1 6/2000
DE 199 25 917 A1 12/2000
EP 0 318 761 A1 6/1989

* cited by examiner

*Primary Examiner*—Frankie L. Stinson
*Assistant Examiner*—Joseph L. Perrin
(74) *Attorney, Agent, or Firm*—Laurence A. Greenberg; Werner H. Stemer; Ralph E. Locher

(57) ABSTRACT

The washing machine has a drum, which rotates inside a fixed suds container about an axis that rises toward the loading opening. Scooping devices mounted on the drum scoop suds onto the laundry with a scooping power that depends on the direction of rotation of the drum. In the scooping direction, the scooping devices uniformly wet the articles to be washed with the suds. During the wet treatment phase the drum is operated in alternating directions of rotation and with a speed that changes according to the direction of rotation for a respectively limited duration that can be varied in both directions of rotation. During the entire wet treatment phase the drum is driven in the scooping direction with equal time intervals and with uniform setpoint speed. The speed and the duration of the time intervals vary counter to the scooping direction along a wetting phase, a washing phase, and a rinsing phase.

5 Claims, 1 Drawing Sheet

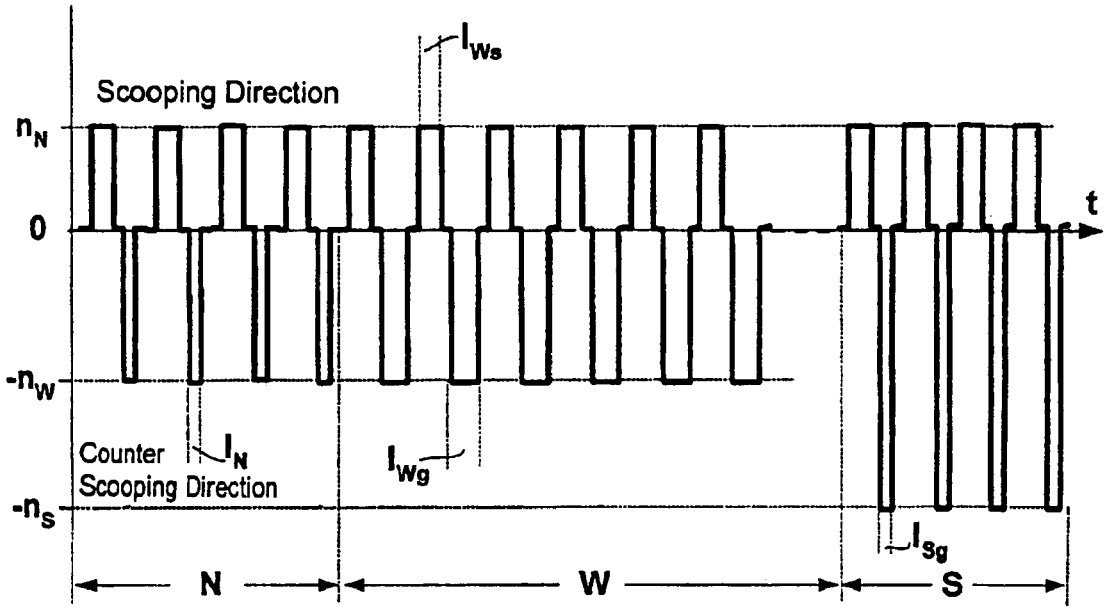
Scooping Direction
$n_N$
0
$-n_W$
$-n_S$
t
$I_{Ws}$
$I_N$
$I_{Wg}$
$I_{Sg}$
Counter
Scooping Direction
N
W
S

METHOD FOR OPERATING A PROGRAMMABLE WASHING MACHINE AND CORRESPONDING WASHING MACHINE

CROSS-REFERENCE TO RELATED APPLICATION

This application is a continuation, under 35 U.S.C. § 120, of copending international application No. PCT/EP02/05625, filed May 22, 2002, which designated the United States. Further, the application claims the benefit, under 35 U.S.C. § 119, of German patent application 101 36 519.5, filed Jul. 26, 2001, the disclosure of which is hereby incorporated by reference in its entirety.

BACKGROUND OF THE INVENTION

Field of the Invention

The invention relates to a method for operating a programmable washing machine with a drum that rotates in a stationary suds container, with a tilted axis of rotation which rises toward the loading opening, and with scooping mechanisms for the suds attached to the drum, whose scooping power is dependent on the direction of drum rotation and which produce uniform wetting of the washed item with the suds in a forward direction of rotation. During the wet processing phase, the drum is driven in alternating directions of rotation and at correspondingly alternating speeds of rotation for a limited period which can be varied in both directions.

The reverse driving of washing machines, whereby the washing drum rotates in periodically alternating directions, is a well established means of improving washing efficiency.

The commonly assigned U.S. Pat. No. 5,560,061 and German published patent application DE 43 10 595 A1 describe a control for reverse driving with which greater performance is achieved in connection with a specially designed washing machine. It is provided therein that the first rotation rate be set such that the effect of the scoops that are attached to the shell of the drum is greatest in the scooping direction. In the reverse direction, the rate at which the drum is driven is higher by a multiple thereof, in order to accelerate the exchange of suds during this period. The selection of rotation rates is determined as a function of the load volume and the constructional features of the washing machine such as drum diameter and scooping power of the scoops. The length of the time periods for driving in either direction can also be varied.

The state of the art also includes washing machines with a slanted drum axis that rises toward the front (cf. commonly assigned patent publication US 2002/0000107 A1 and German patent application DE 198 59 571 A1). In connection with a correspondingly adapted housing in the region of the loading opening, this creates a better view into the drum interior and easier access to the laundry for the user.

Washing machines with slanted systems also offer the ability to save water, energy, and laundry detergent, because the laundry in the bottom region of the slanted drum contacts the suds even if only small amounts of water were introduced by virtue of the slant of the drum.

In order to be able to achieve these possible advantages of the tilted system while simultaneously compensating adverse effects of the system, special constructional mechanisms have been developed.

One known washing machine comprises carriers on the shell of the drum configured transverse to the direction of rotation. As a result of the transverse configuration of carriers, in a bias direction of rotation the laundry is conveyed forward in the direction of the loading opening.

The laundry is distributed over the entire surface of the drum just as in the case of a horizontal axis of rotation.

The carriers are constructed as scooping devices and curved along their length. Their volume is particularly large at the lowest point of the drum so as to collect optimally large amounts of suds. The bottom of the carriers is constructed wider in the region of the scoop openings and is tapered in the direction of the loading opening. The ridge height of the carrier is higher in the direction of the loading opening than in the region of the scooping openings. By these measures, and by the appropriate configuring and distributing of the openings in the carrier, upon the lifting of the carrier from a high level the scooped suds can be sprinkled into the drum interior and onto the laundry with a uniform distribution over the length of the axis. It is easy to see that carriers of this type have a bias direction of rotation, in the sense that the carriers generate optimal scooping power only in one direction of rotation, the scooping direction.

A rapid and uniform soaking of the laundry can be achieved with the above-described washing machine. A sufficient amount of mechanical energy, which is needed for successful washing, can also be applied to the laundry.

A disadvantage is that such carriers cannot be used for conventional washing methods, particularly those developed for horizontal systems. That is, the above-described washing machine cannot be driven by known methods in such a way that a relatively good washing result can be achieved in the same washing period.

SUMMARY OF THE INVENTION

It is accordingly an object of the invention to overcome the disadvantages of the heretofore known devices and methods and to lay out a method for driving the washing machine with a tilted drum axis and with reversing operation as described above, in which the advantages of tilted drum systems are fully exhausted while at the same time a good washing result can be achieved in approximately the same period of time. The object of the invention is also to implement the method by optimally simple control-related means and by loading the drive system relatively little.

With the foregoing object in view there is provided, in accordance with the invention, a method of operating an washing machine in which the drum is driven in the scooping direction at intervals which are equally long and which are characterized by a uniform target speed of the drum during the entire wet processing phase. The speed and the duration of the intervals in the direction counter to scooping is varied depending on the progress of the wet processing phase as follows:

- in a first phase, the wetting phase, the drum rpm in the scooping direction is below the washing rpm, and the duration of the time interval in the direction counter to scooping is substantially shorter than in the scooping direction;
- in a second phase, the washing phase, the drum rpms are the same as in the wetting phase, but the duration of the interval in the direction counter to scooping is longer than in the wetting phase;
- in a third phase, the rinsing phase, the drum rpm in the scooping direction is the same as in the wetting and washing phases, but the drum rpm in the opposite direction is markedly above a contact rpm at which the laundry contacts the drum shell, and the duration of the time interval in said opposite direction is markedly shorter than in the washing phase.

It is advantageous when the wetting phase and washing phase alternate multiple times during the wet processing phase. As a result, the laundry is always well soaked during the washing process. This increases the effectiveness of the dirt elimination.

With the inventive method, a very good washing result which is on a par with known methods is achieved with a lower water and energy consumption and with the washing period more or less unchanged. The sequence of the method is very simple, and the outlay for controlling it is small.

According to a development of the inventive method, it is advantageous to automatically adjust the length of the time interval in the scooping direction by means of a device for detecting the load on the drum that is produced by the laundry. This can be accomplished automatically by the control given the provision of a corresponding collection of measurement data.

In a washing machine for carrying out the inventive method, output signals of a timer in the program control device can be advantageously provided for the purpose of controlling the drum drive, the period of which signals is adjustable in dependence on program steps and/or process parameters that are measured during the wet processing phase.

In further summary, the washing machine has a drum, which rotates inside a fixed suds container and which has an inclined rotation axis that rises toward the loading opening and is provided with scooping devices, which are mounted on the drum and scoop the suds with a scooping power that depends on the direction of rotation of the drum. In a preferred direction of rotation, i.e., the scooping direction, the scooping devices uniformly wet the articles to be washed with the suds. During the wet treatment phase, the drum is operated in alternating directions of rotation and with a rotational speed that changes according to the direction of rotation for a respectively limited duration that can be varied in both directions of rotation. According to the invention, the drum is operated during the entire wet treatment phase in the scooping direction in time intervals $I_N$, $I_W$, $I_S$, which are of approximately equal length and characterized by a uniform specified rotational speed of the drum. In addition, the rotational speed and the duration of the time intervals $I_{Ng}$, $I_{Wg}$, $I_{Sg}$ vary in the direction counter to that of the scooping according to the progress of the wet treatment phase. In a first phase, wetting phase N, the rotational speed of the drum $n_N$ in the scooping direction is less than the washing rotational speed $n_W$, and the duration of the time interval $I_{Ng}$ in the direction counter to that of the scooping is significantly shorter than in the scooping direction. In a second phase, washing phase W, the rotational speeds $n_W$ and $-n_W$ of the drum are the same as in the wetting phase, the duration of the time interval $I_{Wg}$ in the direction counter to that of the scooping is, however, extended in comparison to the wetting phase N. In a third phase, rinsing phase S, the rotational speed $n_N$ of the drum in the scooping direction, is equal to that in the wetting and washing phase but, in the direction counter to that of the scooping ($-n_S$), is significantly greater than an application rotational speed in which the laundry rests against the drum surface, and the duration of the time interval $I_{Sg}$ in the direction counter to that of the scooping is significantly shorter than in the washing phase W.

Other features which are considered as characteristic for the invention are set forth in the appended claims.

Although the invention is illustrated and described herein as embodied in a method for operating a programmable washing machine and appertaining washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The sole view of the drawing is a diagram representing the time characteristic of a wet processing phase that is divided into three functionally distinct portions N, W, and S.

DESCRIPTION OF THE PREFERRED EMBODIMENTS

Referring now to the FIGURE of the drawing in detail, the diagram represents the time characteristic of a wet processing phase that is divided into three functionally distinct segments or portions N, W, and S. In a first portion N at the beginning of the wet processing phase, it is important that the laundry that has been introduced into the drum, typically in a dry condition, be wetted optimally rapidly. Hence the first segment is called the "wetting phase." The inventive reversing rhythm achieves this by the drum being moved in the scooping direction at a rotational speed (rpm) that is optimal for the scooping power and therefore optimal for the sprinkling of the laundry in the drum, as determined by the constructional design of the carriers, which are constructed as a scooping mechanism. In any case, the speed is below the speed that has proven optimal for washing.

The optimal length of the time period during which the drum rotates in the scooping direction is dependent on the scooping power and the load on the drum. The rotation in the opposite direction in the wetting phase serves for more effective stirring of the laundry in the drum. The rotation period for this can be set very short.

With this washing machine operation, the laundry can be evenly soaked in a very short time in the wetting phase.

In the second phase, the washing phase, the washing effect is increased by the intensive flushing of the laundry and the absorption of mechanical energy.

Accordingly, the drum speeds are the same as in the wetting phase, but the period in the direction counter to scooping is longer than in the wetting phase.

In the rinsing phase, the dirty washing suds in the laundry has to be rapidly exchanged for fresh rinsing liquid. This is achieved by the optimal rotation in the scooping direction and the quick alternation into the opposite direction at a higher speed. To that end, the drum rpm in the scooping direction is the same as in the wetting and washing phases, but the rpm in the opposite direction is markedly above a contact rpm at which the laundry adheres to the drum shell. Furthermore, the length of the time period in the direction counter to scooping is markedly shorter than in the washing phase.

Only a few parameters are needed in order to carry out the inventive method, and therefore the control can be constructed simple. To control the drum drive merely requires the provision of output signals of a timer in the program control device, whose period can be adjusted in dependence on program steps and/or processing parameters that are measured during the wet processing phase. The load on the drive system is relatively small as a result of the relatively uniform mode of operation and the avoidance of extremely high speeds.

We claim:

1. A method of operating a programmable washing machine, the washing machine having a drum mounted for rotation in a stationary suds container about a tilted axis of rotation rising towards a loading opening of the washing machine, the drum having scooping mechanisms for suds mounted thereto, the scooping mechanisms having a scooping power depending on a direction of rotation of the drum and being configured for uniformly wetting a laundry with the suds upon rotation of the drum in a given scooping direction, the method which comprises:

driving the drum during a wet processing phase in alternating directions of rotation at speeds that alternate in dependence on the direction of rotation for a respectively limited time period, and the respectively limited time period is variable in both directions of rotation, and thereby:

driving the drum in the scooping direction for time intervals that are equally long and that are characterized by a uniform setpoint speed of the drum during the entire wet processing phase; and driving the drum in an opposite direction and varying the speed and the time intervals in dependence on a progress of the wet processing phase, by:

in a first phase, setting the drum speed in the scooping direction to below a washing speed, setting the duration of the time interval in a direction counter to the scooping direction substantially shorter than the duration in the scooping direction;

in a second phase, setting the drum speed to equal the drum speed in the first phase, and setting the duration of the interval in the direction counter to the scooping direction longer than in the first phase; and in a third phase, setting the drum speed in the scooping direction to equal the drum speed in the first and second phases, but markedly above a contact speed at which items of laundry contact the drum shell in the opposite direction, and setting a duration of the time interval in the opposite direction markedly shorter than in the second phase.

2. The method according to claim 1, wherein the first phase is a wetting phase, the second phase is a washing phase, and the third phase is a rinsing phase.

3. The method according to claim 1, which comprises alternating the scooping direction and the opposite direction multiple times during the wet processing phase.

4. The method according to claim 1, which comprises determining a load on the drum generated by the laundry, and automatically adjusting at least one of a length of the time period in the scooping direction and a length of the time period in the direction counter to scooping in accordance with the load.

5. A washing machine, comprising:

a program control device programmed to carry out the method according to claim 1;

a timer providing output signals to the program control device for controlling the drum drive, the signals defining periods that are adjustable in dependence on program steps and/or process parameters measured during the wet processing phase.

* * * * *